US008794872B2

(12) United States Patent
Sevre

(10) Patent No.: US 8,794,872 B2
(45) Date of Patent: Aug. 5, 2014

(54) METHOD FOR CONSTRUCTING MEMBRANE LINED STRUCTURES FOR HOLDING LARGE FLUID VOLUMES

(76) Inventor: Alf Kolbjoern Sevre, Houston, TX (US)

( * ) Notice: Subject to any disclaimer, the term of this patent is extended or adjusted under 35 U.S.C. 154(b) by 0 days.

(21) Appl. No.: 13/586,970

(22) Filed: Aug. 16, 2012

(65) Prior Publication Data

US 2014/0050528 A1 Feb. 20, 2014

(51) Int. Cl.
*B65D 90/24* (2006.01)

(52) U.S. Cl.
USPC ..... 405/52

(58) Field of Classification Search
CPC ..... B65D 90/24
USPC ..... 405/52, 114, 129.75, 129.6, 129.1, 405/129.45, 129.8, 129.95, 129.55; 220/1.6, 495.01, 723, 721, 720, 220/FOR. 122, FOR. 120, FOR. 115, 220/FOR. 112; 383/3; 52/169.1; 4/506, 588
See application file for complete search history.

(56) References Cited

U.S. PATENT DOCUMENTS 3,008,214 A * 11/1961 Foster et al. ..... 428/12
3,256,532 A * 6/1966 Lindsey et al. ..... 52/284
3,641,595 A * 2/1972 Viessmann ..... 52/300
3,660,853 A * 5/1972 Ducrocq et al. ..... 4/506
3,889,743 A * 6/1975 Presnick ..... 165/46
3,931,652 A * 1/1976 Navarra ..... 4/588
4,473,978 A * 10/1984 Wood ..... 52/169.8
4,672,888 A * 6/1987 Crombie et al. ..... 454/254
4,756,033 A * 7/1988 Schelfhorst ..... 4/506
4,765,775 A * 8/1988 Kroger ..... 405/52
4,801,213 A * 1/1989 Frey et al. ..... 383/3
4,860,916 A * 8/1989 Winters ..... 220/4.33
4,941,754 A * 7/1990 Murdock ..... 383/3
5,622,262 A * 4/1997 Sadow ..... 206/522
5,624,035 A * 4/1997 Kim ..... 206/522
5,769,232 A * 6/1998 Cash et al. ..... 206/522
5,882,142 A * 3/1999 Siglin et al. ..... 405/52
5,924,144 A * 7/1999 Peterson ..... 4/488
5,987,661 A * 11/1999 Peterson ..... 4/506
D425,165 S * 5/2000 Klimenko ..... D21/815
6,202,370 B1 * 3/2001 Miller et al. ..... 52/169.14
6,230,451 B1 * 5/2001 Stoller ..... 52/169.1
6,405,386 B1 * 6/2002 Chang ..... 4/506
6,695,534 B2 * 2/2004 Cain et al. ..... 405/52
7,943,051 B2 * 5/2011 Dieziger ..... 210/767
8,074,406 B2 * 12/2011 Ksenych et al. ..... 52/169.7
2003/0128898 A1 * 7/2003 Malone et al. ..... 383/3
2003/0136506 A1 * 7/2003 Malone et al. ..... 156/275.1
2004/0096276 A1 * 5/2004 Startteim et al. ..... 405/129.8

(Continued)

OTHER PUBLICATIONS

US Department of Transportation Fideral Highway Administration, Highway Traffic Noise, recorded by Wayback Machine Oct. 18, 2011, http://www.fhwa.dot.gov/environment/noise/.*

*Primary Examiner* — Thomas B Will
*Assistant Examiner* — Jessica H Lutz

(57) ABSTRACT

A membrane lined structure for storing large fluid volumes comprising a base surrounding by supporting wall structures, and lined with a double membrane sealed at the edges and formed into a plurality of cellular components which can be inflated and deflated to assist in positioning for purposes of constructing the structure and securing the liner to the upper edges of the structural walls. The cellular membranes can further be monitored to ensure the integrity of the membrane liner prior to filling of the structure or during regular operations.

4 Claims, 6 Drawing Sheets

(56) References Cited

U.S. PATENT DOCUMENTS

| | | | | |
|---|---|---|---|---|
| 2004/0161175 | A1* | 8/2004 | Malone et al. | 383/110 |
| 2005/0196078 | A1* | 9/2005 | McKinney et al. | 383/110 |
| 2009/0175684 | A1* | 7/2009 | Barrett et al. | 405/52 |
| 2009/0178191 | A1* | 7/2009 | MacLean | 4/506 |
| 2010/0028081 | A9* | 2/2010 | Barrett et al. | 405/52 |
| 2010/0303387 | A1* | 12/2010 | Dahlquist | 383/3 |
| 2011/0225719 | A1* | 9/2011 | Tong | 4/506 |
| 2012/0076588 | A1* | 3/2012 | Dupuis et al. | 405/107 |
| 2012/0204498 | A1* | 8/2012 | Richey | 52/102 |
| 2012/0261414 | A1* | 10/2012 | Mann et al. | 220/62.21 |

* cited by examiner

METHOD FOR CONSTRUCTING MEMBRANE LINED STRUCTURES FOR HOLDING LARGE FLUID VOLUMES

BACKGROUND OF THE INVENTION

Oil and gas exploration, completion, and production operations often require the handling, transfer, and storage of large fluid volumes. Hydraulic fracturing techniques can require more than five million gallons of water per well. This large volume can be stored on site prior to and between fracturing operations, for storage, reuse and/or treatment and disposal. In addition, wells may produce large quantities of water during production. Due to environmental concerns, this water must be stored in a manner which will prevent contamination of the surrounding environment.

Often, large open pits are dug near the wells and used to store the water on or close to the well site. Environmental concerns are beginning to limit this practice. In addition to being unsightly, these pits can cause groundwater contamination, and are potential hazards to local livestock or wild animals long after drilling, completion, and production operations. Another option is the construction of steel tanks on site for storing fluid. The cost of construction, maintenance, and removal makes these options impractical in many cases.

As an alternative to pits and tanks, large fleets of tanker trucks, sometimes known as frac tanks have been employed to store fluid on a well site. Though these tanks can be redeployed from site to site recouping some of their cost more efficiently than built on site tanks, the enormous amount of resources necessary to move a fleet of tanks from site to site reduces the potential cost savings. Further, in environmentally sensitive areas, the movement of such large amounts of equipment may have serious consequences to roads and the local environment as well as create a disturbance to communities in which this equipment comes into contact.

A recent solution to the above problems has been the use of temporary tanks built on site for the storage of fluids. The problem with construction on site is that it can be costly and time consuming. A preferred method is to prepare a surface, erect a retaining wall of appropriate dimensions and then line the tank with a waterproof liner. The liner is heavy and difficult to install. Due to the thickness of the material used in the liner, it may take ten to twenty men and heavy equipment to maneuver the liner in place, and then lift the liner in small sections to secure it to the top of the wall.

Liners are large and bulky, and a full inspection can be extremely time consuming, if it can be accomplished at all. Due to the industrial environment and the large impact a small leak can have on the surroundings, it is often desirable to utilize more than one liner as a safety measure further increasing the effort and expense of erecting such a container. Liners are typically only used once and need to be disposed of after the tank is moved. This adds a significant cost to the storage operation and creates an additional waste stream. In the case that these tanks are used to store anything other than fresh water (such as produced or fracturing fluid flow back water), two or more liners are usually required, significantly increasing the overall cost of storage.

DETAILED DESCRIPTION OF THE PREFERRED EMBODIMENTS

Figure 1:
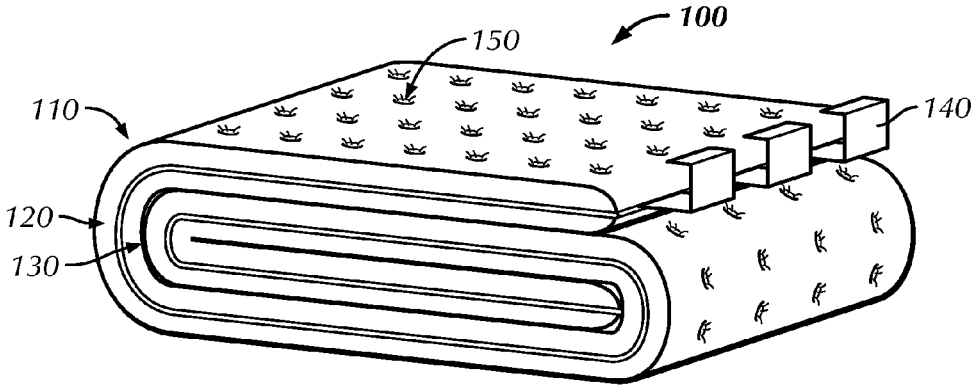
FIG. 1 illustrates an inflatable liner in accordance with an exemplary embodiment of the invention.

The oil and gas industry would be better served with fluid storage solutions which have the following attributes:

- low manpower requirements for installation,
- reusable components leading to cost reductions,
- minimal environmental impact,
- 100% liner contingency,
- ability to test liner integrity,
- ability to store
  - fresh water,
  - produced water,
  - fracturing fluid flowback water,
  - drilling fluids and
  - a combination of fluids.

Described herein is an alternative to the large bulky single or multiple liners of a built tank. The innovation described allows construction of a large holding tank or pit on site with multiple liners to significantly reduce the probability of leaks and a method to leak test the liner while allowing the complete system to be installed in less time and with less man power than that required with previous systems.

In one embodiment, a base is prepared as with previous systems. Such a base should be relatively flat and smooth so as not to create a puncture hazard for the liner and to be stable enough to support the weight of the tank when full. The preferred method is to grade and level the existing ground at the desired location, removing any large rocks, wood, or other materials which may puncture the liner. Optionally the base may be covered with a protective material such as, sand, earth, mulch, fabric, pads, or other materials which would be obvious to one skilled in the arts.

Next, the retaining wall is constructed around the perimeter of the tank. The retaining wall may be constructed of one or more sheet materials erected into a vertical wall fashion, joined at corners to form the desired shape, and optionally reinforced along the top edge and at various locations along the walls. One skilled in the arts would appreciate that a tank could be constructed in many configurations to accommodate the environment and surrounding structures with a plurality of sides and corners which may be right angles, or may be obtuse or acute angles. Further, a single side may be curved to avoid any angled corners. For ease of discussion the presumed shape described herein will be that of a rectangular tank and specifically a substantially square tank. One skilled in the arts would appreciate that a dug earthen pit could be used instead of above ground retaining walls.

In the preferred method utilized by the inventors, a plurality of blocks or panels are utilized to construct a wall around the perimeter of the desired tank. The blocks comprise a mating system which joins upper and lower blocks, and optionally horizontally adjacent blocks. In one embodiment the joining is accomplished by a tongue like protrusion along the top middle of the blocks which mates with a groove-like indention along the middle of the block's bottom side. In the preferred embodiment, the blocks have a plurality of additional grooves along the bottom side oriented perpendicular to the main groove and allowing for the interlocking of multiple blocks oriented perpendicular to one another to form a structurally reinforced corner of approximately ninety degrees (90°).

In one embodiment the blocks are hollow forms with capped openings in the bottom, or lower edge of one side, and at the top. The blocks are formed such that they have an inner compartment and an outer surface. The outer surface is structured as previously described, and the inner compartment may be filled with a weighted substance after positioning, giving the block, additional weight and inertia to prevent it from moving. The block may be filled with any flowable substance examples of which may include, but not be limited to water, sand, mud, drilling fluids.

The liner is constructed with a dual sheet membrane which is sealed around the edges to create an air pocket which is substantially rectangular in shape and the approximate size of the base of the tank or of one of the interior walls of the tank. The liner has vents which allow the liner to be inflated. One skilled in the arts would appreciate that other shapes are achievable in accordance with the teachings given here. Reinforcing strips throughout the interior space created by joining the edges of the dual membrane keep the liner in a semi-flat state such that the membranes remain in a substantially parallel arrangement rather than expanding out further in some area than in others. One skilled in the arts would appreciate that other configurations would be in accordance with the teaching such as multiple vertical compartments or multiple vertical compartments joined together to form a single larger compartment, either with individual inflation points, or a single shared inflation point.

The inflation of the liner helps to position it by allowing the force of the air to unfurl, unroll, or otherwise spread out the liner without the need of large amounts of man power or heavy equipment. In the preferred embodiment, the liner consist of a bottom compartment, and four side compartments, each of the side compartments being joined on the vertical edges with their neighboring wall compartments, and being joined on the lower horizontal edges with the edges of the bottom compartment to form a box like shape. In the preferred embodiment each of the bottom and the wall compartments has individual single inflation points and each of the compartments may be inflated and deflated separately.

The liner constructed as described above has the advantage that it can be aligned in the center of the tank's base prior to wall construction, or lowered over the wall after wall construction or lowered into an earthen pit. Inflating the bottom compartment causes it to spread over the base and positions the wall compartments, which are attached to the edges of the base, against the walls of the tank. Then by inflating the walls one at a time, the pressure causes them to erect themselves and support one another thus raising the liner to the upper edge of the tank's supporting walls. Once the liner's wall compartments are erected by air pressure it takes minimal man power to secure the top edge of the liner's walls to the tank's supporting walls.

The liner may then be maintained under pressure for a prescribed time to ensure there are no leaks, or to allow for the identification and repair of leaks. Once the integrity of the liner's membrane has been verified, the bottom compartment may be deflated prior to filling of the tank with fluid. The wall compartments may be deflated after securing them to the top of the supporting walls, or may be deflated slowly as the tank is filled with fluid. By deflating as the tank is filled, the air in the wall compartments will be forced up by the fluid's pressure further stretching the walls up the side of the tank.

Turning to the figures, FIG. 1 illustrates an inflatable liner in accordance with an exemplary embodiment of the invention. The liner (100) is shown in a folded configuration, as it would be configured for transport, or for placing prior to inflation during the structure's construction. Note that the actual configuration of the fold is not an element of this disclosure. The liner (100) as illustrated comprises a external membrane (110) lying substantially parallel to an inner membrane (130) both separated by a thicker structurally supporting internal membrane (120). In other embodiments, the inner and/or outer membrane may provide sufficient structural support such that an additional internal membrane may be unnecessary. In other embodiments additional internal membranes may be incorporated to provide additional structural support or additional layered protection against fluid penetration. The membranes are joined at regular intervals (150) to retain their substantially parallel arrangement during inflation. At least one edge of the membranes may comprise extension straps (140) for securing the liner to the upper edge of the supporting wall of the structure. In the illustrated embodiment, the supporting straps are a plurality of non-contiguous supporting members configured as tabs structurally attached to the inner membrane. In another embodiment, the supporting element may be a plurality of contiguous, or they may be a single tab extending the length of the supported edge. In other embodiments the supporting member(s) may be secured to a plurality of the membranes comprising the edge of the liner.

Figure 2:
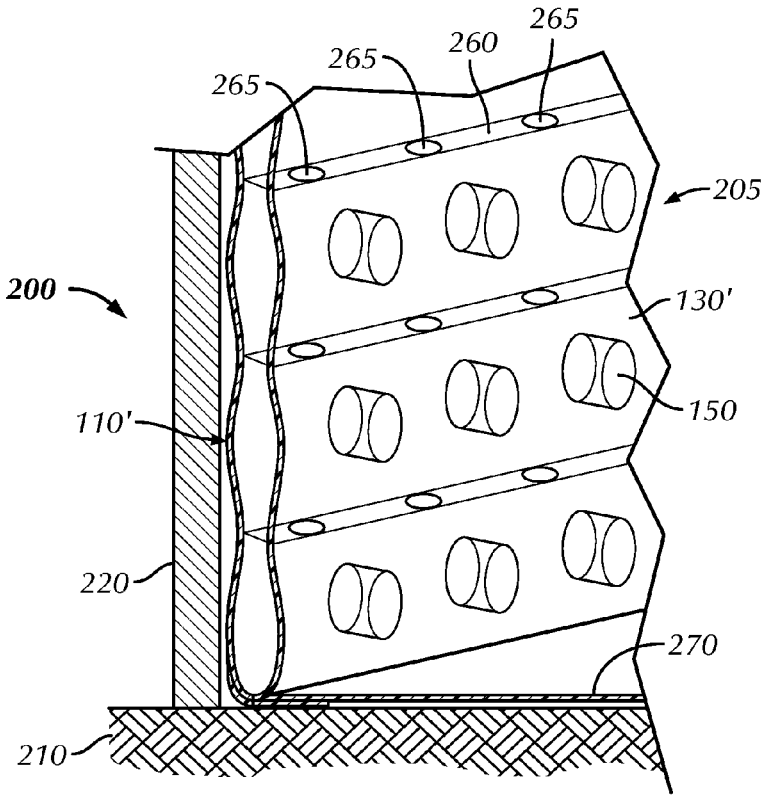
FIG. 2 illustrates a cross section of a portion of a membrane lined structure in accordance with an exemplary embodiment of the invention.

FIG. 2 illustrates a cross section of a portion of a membrane lined structure in accordance with an exemplary embodiment of the invention. The illustration (200) shows an embodiment with a dual membrane (110' and 130') creating a wall compartment (205) which is installed in a lower corner where a structural wall section (220) meets the base (210) of the structure. The inner membrane (130') is joined to the outer membrane (110') by a series of connections (150) and/or by strips (260) which may optionally contain voids (265) which allow air to flow freely between compartments. In this illustration, the wall compartment (205) is inflated, but the base compartment (270) is shown deflated.

Figure 3:
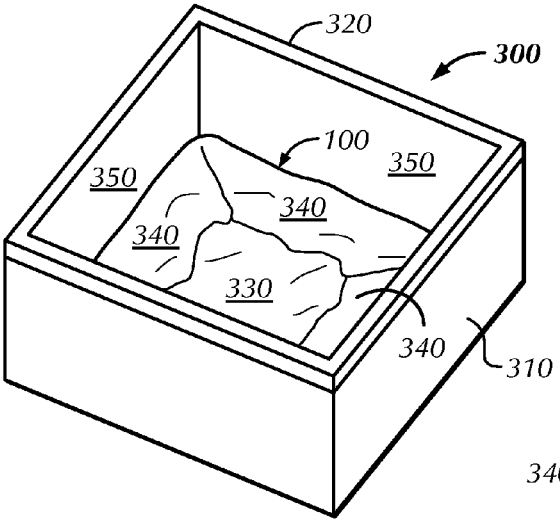
FIGS. 3-5 show a component steps of erecting a membrane lined structure in accordance with an exemplary embodiment of the invention.
Figure 4:
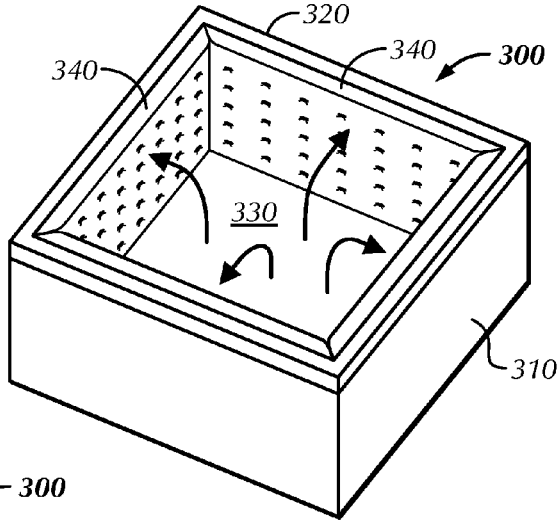
Figure 5:
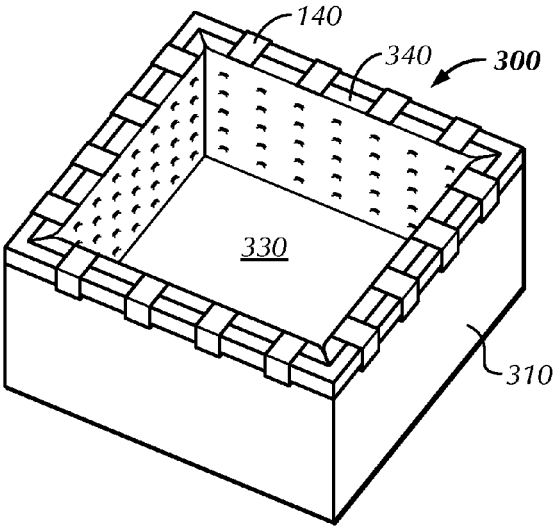

FIGS. 3-5 show the steps of erecting a membrane lined structure in accordance with an exemplary embodiment of the invention. In FIG. 3, the structure (300) comprises a structural supporting wall (310) which optionally is reinforced at the top (320) and other locations (not illustrated), and an inflatable liner (100). The liner (100) is placed inside the structural supporting wall (310) either before or after construction. The base compartment (330) is inflated forcing the wall compartments (340) into the corners where the wall's (310) interior surfaces (350) meet the base. FIG. 4 illustrates the process as the wall compartments (340) are inflated causing them to rise from the bottom compartment (330) to meet the wall (310) such that the top of the wall compartments (340) are near the reinforced top (320) of the structural wall (310). Next, FIG. 5 shows the extension straps (140) securing the upper edge of the wall section (340) to the upper edge of the supporting wall (310) completing the lining of the structure (300). One skilled in the art would appreciate that the extension straps (140) may comprise an extension of the fabric which folds over the top and is secured by clamps, clips, binders, or simply friction. Further, the extensions straps may be loops, or tabs with holes or eyelets, or other means of securing them to the top of the supporting wall which may include hooks, connection points, etc. as would be appreciated by one skilled in the arts.

Figure 6:
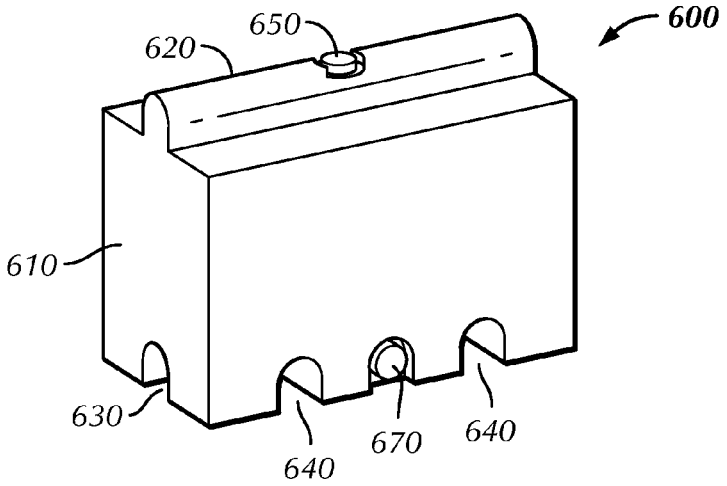
FIGS. 6-9 show a wall section in accordance with an exemplary embodiment of the invention.
Figure 7:
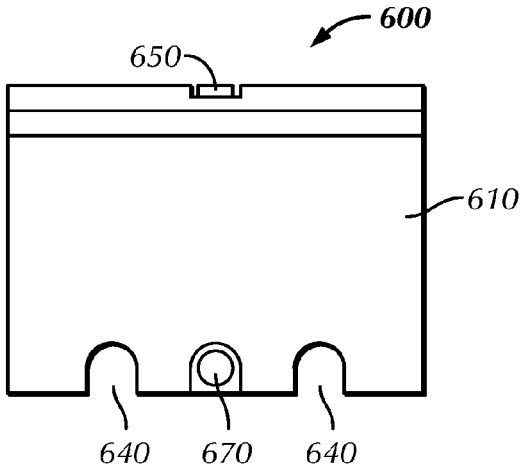
Figure 8:
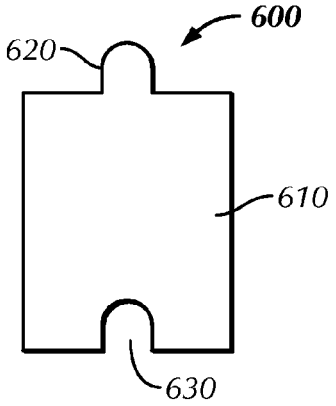
Figure 9:
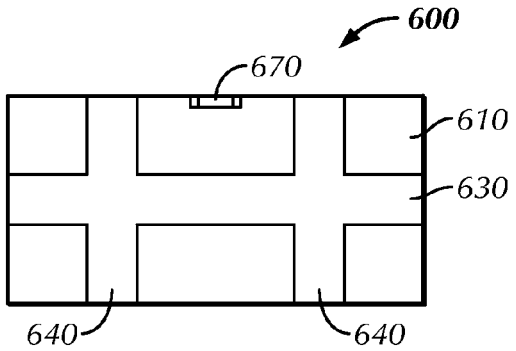

FIGS. 6-9 show a wall section in accordance with an exemplary embodiment of the invention. FIG. 6 illustrates the block in perspective view. FIG. 7 is a side view of the block (600). FIG. 8 is an end view of the block (600). FIG. 9 is a bottom view of the block (600). The wall section (600) or block is comprised of a hollow main body structure (610) which has a tongue (620) along the center of the top and running length wise along the center from end to end. Corresponding to the tongue (620) is a center groove (630) along the center of the bottom and running length wise along the center from end to end. The tongue and groove are positioned such that they mate when one block is stacked atop another the block then being interconnected such that they may only slide in a single horizontal direction perpendicular to the structural face of the wall. The block (600) further comprises additional short grooves (640) running perpendicular to the center groove (630) from side to side. Ideally the block would have a rectangular shape with the length of sides being longer than the length of the ends. These grooves mate with the tongue of a second block positioned perpendicular to the face of the first block to form an angled locking interface. The block further comprises a resealable opening (650) in the top of the block (600) illustrated herein as being in the tongue (620). This opening is utilized to fill the block adding mass which further secures the block in place. The block also comprises a resealable opening (670) in the bottom of the block, or the lower edge of a wall of the block's main body structure (610). Optionally the resealable openings (650 and 670) are recessed such that they do not substantially interfere with the stacking of the blocks or the relative smoothness of the walls face.

Figure 10:
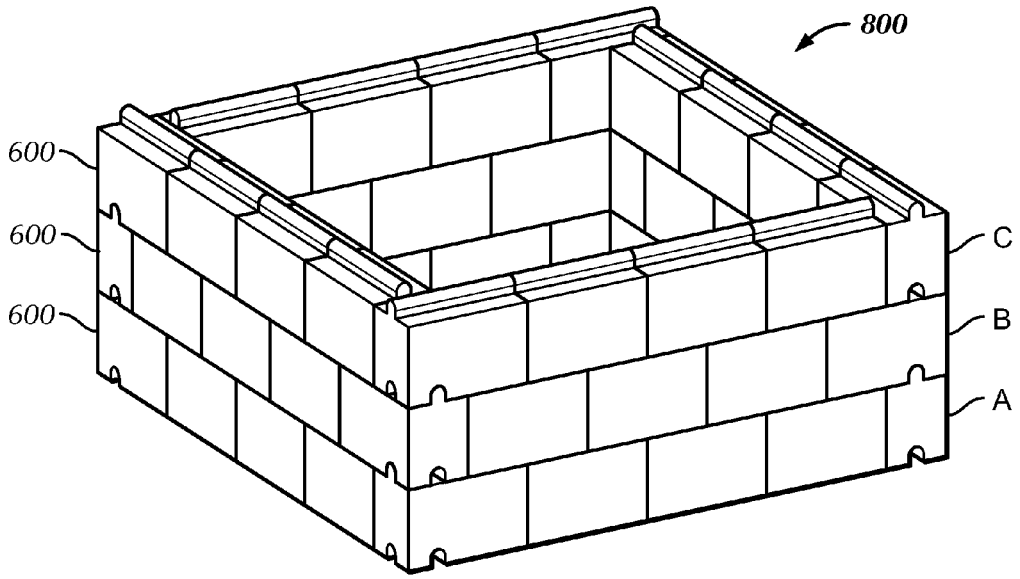
FIG. 10 shows a structural retaining wall constructed from individual wall sections in accordance with an exemplary embodiment of the invention.

FIG. 10 shows a structural retaining wall constructed from individual wall sections in accordance with an exemplary embodiment of the invention. Here the structure (800) comprises three rows (A, B, C) of individual blocks (600). The blocks (600) are stacked in a stretcher bond or running bond. Here, the interlocking of the tongue to the short groove is shown at the corners.

Figure 11:
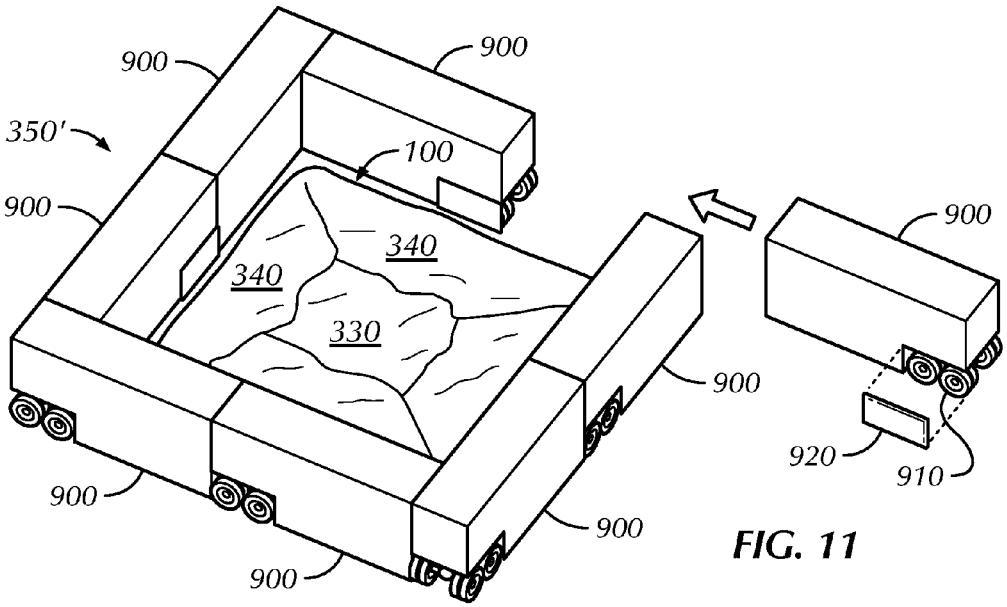
FIG. 11 shows an alternative structural retaining wall constructed from individual trailer rigs forming the wall sections in accordance with an exemplary embodiment of the invention.

FIG. 11 shows an alternative structural retaining wall constructed from individual trailer rigs forming the wall sections in accordance with an exemplary embodiment of the invention. Here the structural wall (350') is comprised of a plurality of trailer rigs (900). The structural wall (350') support the wall compartments (340) which encircle and are joined to the floor or base compartment (330) to form a membrane lined storage structure. The wheel assemblies (910) of the trailers (900) are protected by optional fill plates (920) which prevent the liner's wall compartments (340) from being compromised by the wheel assemblies (910) or unsupported in the localized area. In addition to providing the structural wall (350') the trailer rigs (900) may also be utilized as storage containers. In such a use, one would then have extra capacity, or a plurality of isolated storage containers for segmentation of liquids and/or semi-liquids.

Figure 12:
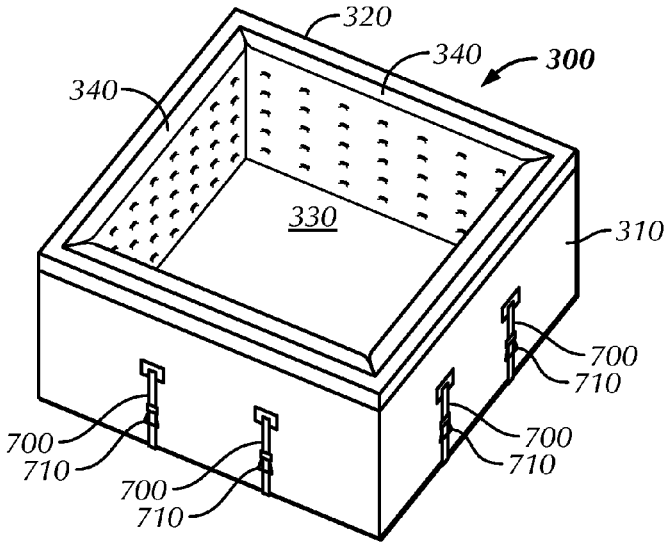
FIG. 12 shows the use of straps secured to the base compartment in accordance with an exemplary embodiment of the invention.

FIG. 12 shows the use of straps secured to the base compartment in accordance with an exemplary embodiment of the invention. The straps (700) are secured to the underside of the base compartment (330) and extend outward under the structural walls (310) and are secured at some point to the structural walls (310). Thus secured, adjustable connections (710) allow the tightening or loosening of straps to shift the base compartment (330) in the direction of the tightening strap (700). Tightening straps (700) on opposing sides would not allow shifting of the base compartment (330) but instead would serve to support the structural walls (310) from moving outward. Once the base compartment is aligned within the structural walls (310) the wall compartments (340) can be raised and secured to the top edge (320) of the structural walls (310), thus completing the erection of the membrane lined storage structure (300).

Figure 13:
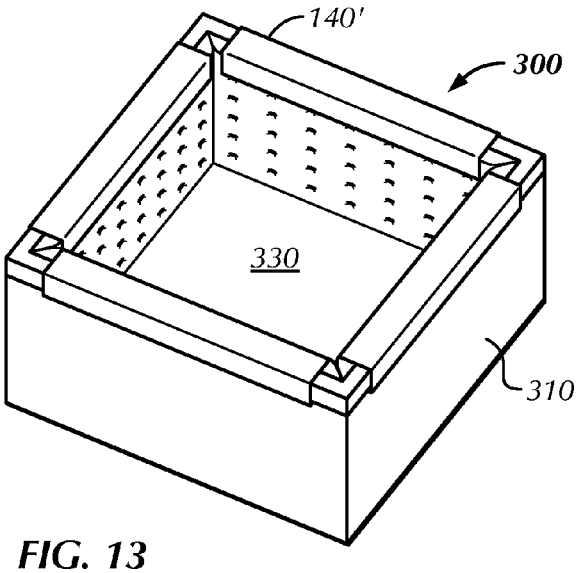
FIG. 13 shows an alternative means of securing the wall compartments to the top edge of the structural retaining wall in accordance with an exemplary embodiment of the invention.

FIG. 13 shows an alternative means of securing the wall compartments to the top edge of the structural retaining wall in accordance with an exemplary embodiment of the invention. In this embodiment the walls (310) of the storage structure (300) and the liner (330) are secured by a C-shaped channel (140') which extends along the top edge of the structural supporting walls (310) and folds over the top edge both on the inner side of the wall compartments (340, not indicated), and on the outer edge of the structural supporting wall (310). Eliminating openings between the wall (310) and the liner (330) prevents wind to penetrate under the liner raising it out of the storage structure (300).

The diagrams in accordance with exemplary embodiments of the present invention are provided as examples and should not be construed to limit other embodiments within the scope of the invention. Illustrations of the components within different figures can be added to or exchanged with other components in other figures. Further, specific numerical data values (such as specific quantities, numbers, categories, etc.) or other specific information should be interpreted as illustrative for discussing exemplary embodiments. Such specific information is not provided to limit the invention. As an example FIG. 10 illustrates three rows of blocks, but one skilled in the art would appreciate that more or less blocks could comprise a structural supporting wall and still be within the scope of the invention described. Further, the structural supporting walls have been illustrated to have a substantially square foot-print. One skilled in the art would appreciate that the shape of the invention may be rectangular, triangular, cylindrical, or even an irregular shape. The limiting factors are that the supporting wall structure be approximately the size of the outside dimension of the liner, or less in order to provide proper wall support. Ideally the shape of the structural supporting wall would be substantially associated with the shape of the liner, but not necessarily provided inflation, support and securing of the liner could be accomplished.

The diagrams in accordance with exemplary embodiments of the present invention are intended to illustrate an embodiment if the invention, not necessarily the only embodiment, and are provided as examples which should not be construed to limit other embodiments within the scope of the invention. For instance, heights, widths, and thicknesses may not be to scale and should not be construed to limit the invention to the particular proportions illustrated. Additionally some elements illustrated in the singularity may actually be implemented in a plurality. Further, some element illustrated in the plurality could actually vary in count. Further, some elements illustrated in one form could actually vary in detail. Further yet, specific numerical data values (such as specific quantities, numbers, categories, etc.) or other specific information should be interpreted as illustrative for discussing exemplary embodiments. Such specific information is not provided to limit the invention.

The above discussion is meant to be illustrative of the principles and various embodiments of the present invention.

Numerous variations and modifications will become apparent to those skilled in the art once the above disclosure is fully appreciated. It is intended that the following claims be interpreted to embrace all such variations and modifications.

What is claimed is:

1. A method for constructing a membrane lined structure for storing large fluid volumes, comprising:

preparing a structural base;

erecting structural wall sections surrounding and substantially encompassing said structural base;

positioning an inflatable liner inside the wall sections and above the structural base, said liner comprising a base cellular section and a plurality of wall cellular sections joined to the perimeter of the base cellular section, wherein each wall cellular section comprises at least two membranes sealed at all edges and a plurality of substantially horizontal support strips distributed between the membranes, wherein each substantially horizontal support strip comprises at least one opening that allows fluid flow therethrough, forming a plurality of inflatable compartments within the wall cellular sections, wherein the substantially horizontal support strips are adapted to retain the membranes substantially parallel to one another when inflated, thereby increasing the structural integrity of the liner when inflated; and inflating the liner by:

first, at least partially inflating the base cellular section;

second, at least partially inflating a first and third wall cellular sections, said first and third wall cellular sections being oriented parallel to each other;

third, at least partially inflating a second and fourth wall cellular section, said second and forth wall cellular sections being oriented parallel to each other, and perpendicularly oriented to said first and third wall cellular sections; and fourth, securing the upper edges of each wall cellular section to a surrounding structural wall section.

2. The method of claim 1 wherein erecting structural wall sections comprises supporting structurally sufficient, substantially flat sheets of material in a vertical position and joining each to its neighbors in parallel or perpendicular orientation to form a plurality of walls and corners in a substantially rectangular shape.

3. The method of claim 1 wherein erecting structural wall sections comprises stacking interlocking block structures in parallel and perpendicular orientations to form a plurality of walls and corners in a substantially rectangular shape.

4. The method of claim 1 further comprising at least partially deflating one or more of the wall cellular sections prior to inflating said inflatable liner with a fluid.

* * * * *